US010504448B2

(12) United States Patent
Kim et al.

(10) Patent No.: US 10,504,448 B2
(45) Date of Patent: Dec. 10, 2019

(54) DISPLAY APPARATUS

(71) Applicant: Samsung Display Co., Ltd., Yongin-si, Gyeonggi-do (KR)

(72) Inventors: Sunghwan Kim, Yongin-si (KR); Junhyun Park, Suwon-si (KR); Kyoungju Shin, Hwaseong-si (KR); Chongchul Chai, Seoul (KR)

(73) Assignee: Samsung Display Co., Ltd. (KR)

( * ) Notice: Subject to any disclaimer, the term of this patent is extended or adjusted under 35 U.S.C. 154(b) by 91 days.

(21) Appl. No.: 15/789,231

(22) Filed: Oct. 20, 2017

(65) Prior Publication Data

US 2018/0122304 A1 May 3, 2018

(30) Foreign Application Priority Data

Nov. 3, 2016 (KR) ..... 10-2016-0145964

(51) Int. Cl.

| | |
|---|---|
| ***G09G 5/10*** | (2006.01) |
| ***G09G 3/32*** | (2016.01) |
| ***G09G 3/30*** | (2006.01) |
| ***G09G 3/3275*** | (2016.01) |
| ***G09G 3/3266*** | (2016.01) |
| ***G09G 3/3258*** | (2016.01) |

(52) U.S. Cl.

CPC ..... *G09G 3/3275* (2013.01); *G09G 3/3258* (2013.01); *G09G 3/3266* (2013.01); *G09G 2300/0408* (2013.01); *G09G 2300/0426* (2013.01); *G09G 2300/0871* (2013.01); *G09G 2310/0289* (2013.01); *G09G 2310/06* (2013.01)

(58) Field of Classification Search

CPC ..... G09G 3/3233; G09G 2310/08

See application file for complete search history.

(56) References Cited

U.S. PATENT DOCUMENTS

| | | | | |
|---|---|---|---|---|
| 7,541,961 | B1 | 6/2009 | Garg | |
| 2009/0295703 | A1* | 12/2009 | Hsieh | G09G 3/3659 345/94 |
| 2013/0120469 | A1* | 5/2013 | Tien | G09G 3/3648 345/690 |
| 2013/0169619 | A1* | 7/2013 | Jeong | G09G 5/001 345/212 |
| 2016/0086978 | A1 | 3/2016 | French et al. | |
| 2018/0083078 | A1* | 3/2018 | Park | H01L 27/3248 |

* cited by examiner

*Primary Examiner* — Nan-Ying Yang

(74) *Attorney, Agent, or Firm* — Innovation Counsel LLP

(57) ABSTRACT

A display apparatus includes a first pixel connected to a first scan line, a second scan line, and a first data line, a second pixel connected to the first scan line and a second data line, and a selection circuit configured to electrically connect a first channel to one of the first data line and the second data line in response to selection signals. A pulse width of a first scan signal configured to be provided to the first scan line and a pulse width of a second scan signal configured to be provided to the second scan line are longer than one horizontal period.

17 Claims, 12 Drawing Sheets

DISPLAY APPARATUS

CROSS-REFERENCE TO RELATED APPLICATION

This U.S. non-provisional patent application claims priority under 35 U.S.C. § 119 of Korean Patent Application No. 10-2016-0145964, filed on Nov. 3, 2016, the contents of which are hereby incorporated by reference in its entirety.

BACKGROUND

1. Field of Disclosure

The present disclosure relates to a display apparatus.

2. Description of the Related Art

In general, a display apparatus includes a display panel displaying an image, a data driving circuit, and a scan driving circuit. The data driving circuit and the scan driving circuit drive the display panel. The display panel includes a plurality of scan lines, a plurality of data lines, and a plurality of pixels. Each of the pixels includes a switching transistor, a liquid crystal capacitor, and a storage capacitor. The data driving circuit outputs a data driving signal to the data lines, and the scan driving circuit outputs a scan driving signal to drive the scan lines.

The display apparatus displays the image by the scan driving circuit that drives the scan lines and the data driving circuit that applies data voltages corresponding to image signals to the data lines.

In recent years, as a size of the display panel increases, the number of the data lines increases. Since the number of the data lines driven by a data driving circuit IC (integrated chip) having a limited size is limited, the number of the data driving circuit ICs required by the display apparatus increases depending on the increase of the size of the display panel.

SUMMARY

The present disclosure provides a display apparatus capable of reducing the number of data driving circuit ICs thereof.

The present disclosure provides a display apparatus capable of preventing a quality of a display image from being deteriorated even though the number of the data driving circuit ICs is reduced.

Embodiments of the inventive concept provide a display apparatus including a first pixel connected to a first scan line, a second scan line, and a first data line, a second pixel connected to the first scan line and a second data line, and a selection circuit configured to electrically connect a first channel to one of the first data line and the second data line in response to selection signals. A pulse width of a first scan signal configured to be provided to the first scan line and a pulse width of a second scan signal configured to be provided to the second scan line are longer than one horizontal period.

The first scan signal and the second scan signal are configured to be sequentially activated, and an active period of the first scan signal partially overlaps with an active period of the second scan signal.

The first pixel includes a first pixel circuit connected to the first scan line and a first switching circuit configured to provide a first data signal, which is provided from the first data line, to the first pixel circuit in response to the second scan signal.

The first pixel circuit includes a first transistor including a first electrode connected to the first switching circuit, a second electrode connected to a first node, and a gate electrode connected to the first scan line, a second transistor including a first electrode configured to receive a first voltage, a second electrode connected to a second node, and a gate electrode connected to the first node, a capacitor connected to and between the first node and the second node, and a first light emitting device including one end connected to the second node and the other end configured to receive a second voltage.

The first transistor is a PMOS transistor. The first switching circuit is an NMOS transistor that includes a first electrode connected to the first data line, a second electrode connected to the first electrode of the first transistor, and a gate electrode connected to the second scan line.

When the second scan signal transmitted through the second scan line is inactive and the first scan signal transmitted through the first scan line is active, the first data signal transmitted through the first data line is provided to the first node.

A period in which the second scan signal transmitted through the second scan line is inactive and the first scan signal transmitted through the first scan line is active is equal to the one horizontal period.

When the first scan signal transmitted through the first scan line is active, a second data signal transmitted through the second data line is provided to the second pixel.

The first transistor is an NMOS transistor. The first switching circuit is a PMOS transistor that includes a first electrode connected to the first data line, a second electrode connected to the first electrode of the first transistor, and a gate electrode connected to the second scan line.

The display apparatus further includes a third pixel connected to the second scan line, a third scan line, and the first data line and a fourth pixel connected to the second scan line and the second data line. The third pixel includes a third pixel circuit connected to the second scan line and a second switching circuit configured to provide the first data signal, which is provided from the first data line, to the third pixel circuit in response to a third scan signal.

The third pixel circuit includes a third transistor including a first electrode connected to the second switching circuit, a second electrode connected to a third node, and a gate electrode connected to the second scan line, a fourth transistor including a first electrode configured to receive the first voltage, a second electrode connected to a fourth node, and a gate electrode connected to the third node, a capacitor connected to and between the third node and the fourth node, and a second light emitting device including one end connected to the fourth node and the other end configured to receive the second voltage.

The first transistor is a PMOS transistor, and the third transistor is an NMOS transistor. The first switching circuit includes a PMOS transistor that includes a first electrode connected to the first data line, a second electrode connected to the first electrode of the first transistor, and a gate electrode connected to the second scan line. The second switching circuit includes an NMOS transistor that includes a first electrode connected to the first data line, a second electrode connected to the first electrode of the third transistor, and a gate electrode connected to the third scan line.

The first scan signal and the third scan signal include an active period having a first level, and the second scan signal includes an active period having a second level.

The second pixel is further connected to the third scan line. The second pixel includes a second pixel circuit connected to the first scan line and a second switching circuit configured to provide the second data signal, which is provided from the second data line, to the second pixel circuit in response to the third scan signal provided through the third scan line.

The second scan signal and the third scan signal are sequentially activated, and an active period of the second scan signal partially overlaps with an active period of the third scan signal.

The display apparatus further includes a gate driving circuit configured to drive the first scan line using the first scan signal and the second scan line using the second scan signal, a data driving circuit configured to sequentially output the first data signal and the second data signal to the first channel, and a driving controller configured to control the data driving circuit and the gate driving circuit.

The selection signals include a first selection signal and a second selection signal. The selection circuit includes a first switching device configured to electrically connect the first channel to the first data line in response to the first selection signal and a second switching device configured to electrically connect the first channel to the second data line in response to the second selection signal.

Embodiments of the inventive concept provide a display apparatus including a selection circuit configured to electrically connect a first channel to one of a first data line and a second data line in response to selection signals, a first pixel circuit connected to a first scan line, a first switching circuit connected to and between the first data line and the first pixel circuit configured to provide a first data signal, which is provided from the first data line, to the first pixel circuit in response to a second scan signal from the second scan line, and a second pixel connected to the first scan line and the second data line. A pulse width of a first scan signal configured to be provided to the first scan line and a pulse width of a second scan signal configured to be provided to the second scan line are longer than one horizontal period.

The first scan signal and the second scan signal are configured to be sequentially activated, and an active period of the first scan signal partially overlaps with an active period of the second scan signal.

A period, in which the second scan signal configured to be transmitted through the second scan line is inactive and the first scan signal configured to be transmitted through the first scan line is active, is equal to the one horizontal period.

According to the above, the display apparatus includes the selection circuit, and thus the number of ICs for the data driving circuit may be reduced. In particular, the display apparatus may obtain enough time to provide the data voltage to each pixel, and thus a decrease in pixel charge rate may be minimized.

BRIEF DESCRIPTION OF THE DRAWINGS

The above and other features of the present disclosure will become readily apparent by reference to the following detailed description when considered in conjunction with the accompanying drawings wherein.

DETAILED DESCRIPTION

Hereinafter, embodiments will be explained in detail with reference to the accompanying drawings.

Figure 1:
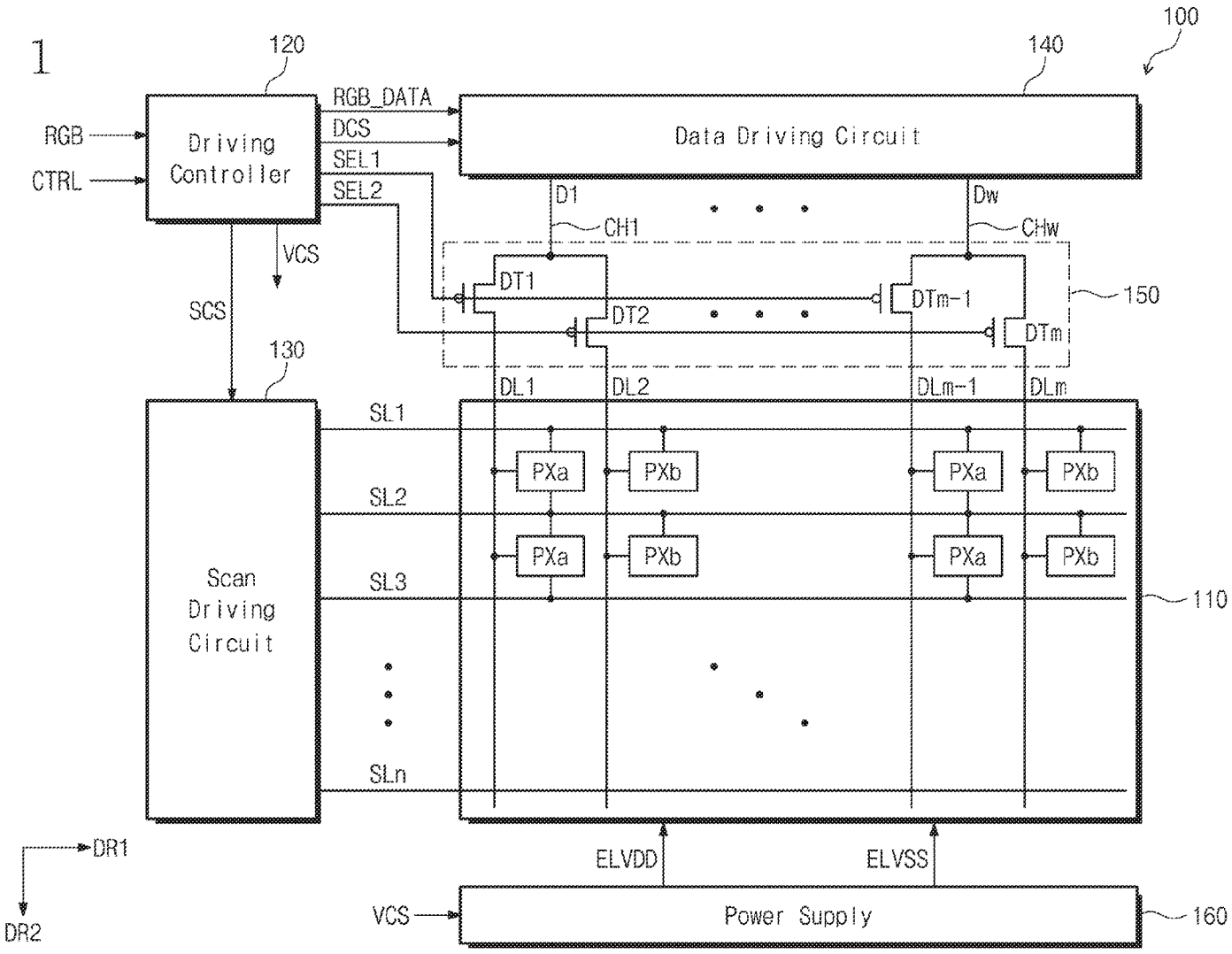
FIG. 1 is a block diagram showing a configuration of a display apparatus according to an exemplary embodiment of the present disclosure.

FIG. 1 is a block diagram showing a configuration of a display apparatus 100 according to an exemplary embodiment of the present disclosure.

Referring to FIG. 1, the display device 100 includes a display panel 110, a driving controller 120, a scan driving circuit 130, a data driving circuit 140, a selection circuit 150, and a power supply 160.

The display panel 110 may be a liquid crystal display panel, an organic light emitting display panel, an electrophoretic display panel, or an electrowetting display panel, but it should not be limited thereto or thereby. In the present exemplary embodiment, the organic light emitting display panel will be described as the display panel 110. Meanwhile, the display apparatus 100 including the liquid crystal display panel 110 may further include a polarizer, a backlight unit, etc., which are not shown in figures.

The display panel 110 includes a plurality of scan lines SL1 to SLn extending in a first direction DR1, a plurality of data lines DL1 to DLm extending in a second direction DR2, and a plurality of pixels PXa and PXb respectively connected to the scan lines SL1 to SLn and the data lines DL1 to DLm. FIG. 1 shows some scan lines of the scan lines SL1 to SLn and some data lines of the data lines DL1 to DLm.

FIG. 1 shows some pixels of the pixels PXa and PXb. Each of the pixels PXa and PXb is connected to a corresponding scan line of the scan lines SL1 to SLn and a corresponding data line of the data lines DL1 to DLm.

The pixels PXa and PXb may be classified into a plurality of groups depending on a color displayed thereby. The pixels PXa and PXb may display one of primary colors. The primary colors include a red color, a green color, a blue color, and a white color, but the primary colors should not be limited thereto or thereby. That is, the primary colors may further include a variety of colors, such as a yellow color, a cyan color, a magenta color, etc.

In the embodiment shown in FIG. 1, a first pixel PXa is connected to odd-numbered data lines DL1, . . . , DLm−1, and a second pixel PXb is connected to even-numbered data lines DL2, . . . , DLm. The first pixel PXa may further he connected to a scan line adjacent to the corresponding scan line in addition to the corresponding scan line. For instance, the first pixel PXa connected to a scan line SL1 and a data line DL1 is connected to a scan line SL2 adjacent to the scan line SL1.

The driving controller 120 applies a data signal RGB-_DATA and a first control signal DCS to the data driving circuit 140 in response to an image signal RGB and a control signal CTRL, which are provided from an external source (not shown), and applies a second control signal SCS to the scan driving circuit 130. In addition, the driving controller 120 applies a first selection signal SEL1 and a second selection signal SEL2 to the selection circuit 150 and applies a third control signal VCS to the power supply 160.

The scan driving circuit 130 sequentially drives the scan lines SL1 to SLn in response to the second control signal SCS from the driving controller 120. The scan driving circuit 130 may be mounted on a side portion of the display panel 110 in the form of an amorphous silicon gate (ASG) circuit or an oxide semiconductor TFT gate (OSG) circuit.

The data driving circuit 140 outputs data output signals D1 to Dw through a plurality of channels CH1 to CHw in response to the data signal RGB_DATA and the first control signal DCS from the driving controller 120.

The selection circuit 150 selectively and electrically connects the channels CH1 to CHw of the data driving circuit 140 to the data lines DL1 to DLm in response to the first and second selection signals SEL1 and SEL2. For instance, responsive to the first and second selection signals SEL1 and SEL2, the selection circuit 150 electrically connects the channel CH1 to one of the data line DL1 and the data line DL2 and electrically connects the channel CHw to one of the data line DLm−1 and the data line DLm. The selection circuit 150 may be provided to a predetermined area of the display panel 100, which is disposed adjacent to the data driving circuit 140, or may be provided to a separate circuit board.

The selection circuit 150 includes a plurality of transistors DT1 to DTm respectively corresponding to the data lines DL1 to DLm. Each of the transistors DT1 to DTm includes a first electrode connected to a corresponding channel among the channels CH1 to CHw, a second electrode connected to a corresponding data line among the data lines DL1 to DLm, and a gate electrode connected to receive a corresponding selection signal of the first and second selection signals SEL1 and SEL2.

Among the transistors DT1 to DTm, odd-numbered transistors are respectively connected to the odd-numbered data lines and are driven in response to the first selection signal SEL1. Among the transistors DT1 to DTm, even-numbered transistors are respectively connected to the even-numbered data lines and are driven in response to the second selection signal SEL2.

For instance, the data output signal D1 output through the channel CH1 from the data driving circuit 140 is applied to one of the data lines DL1 and DL2 through the selection circuit 150, and the data output signal Dw is applied to one of the data lines DLm−1 and DLm through the selection circuit 150. The data driving circuit 140 may drive two data lines using the data output signal output through one channel. Accordingly, the number of the channels of the data driving circuit 140 may be reduced compared to a structure in which the data output signal output through one channel drives one data line.

The power supply 160 supplies a first power voltage ELVDD and a second power voltage ELVSS, which are required to drive the first and second pixels PXa and PXb.

Figure 2:
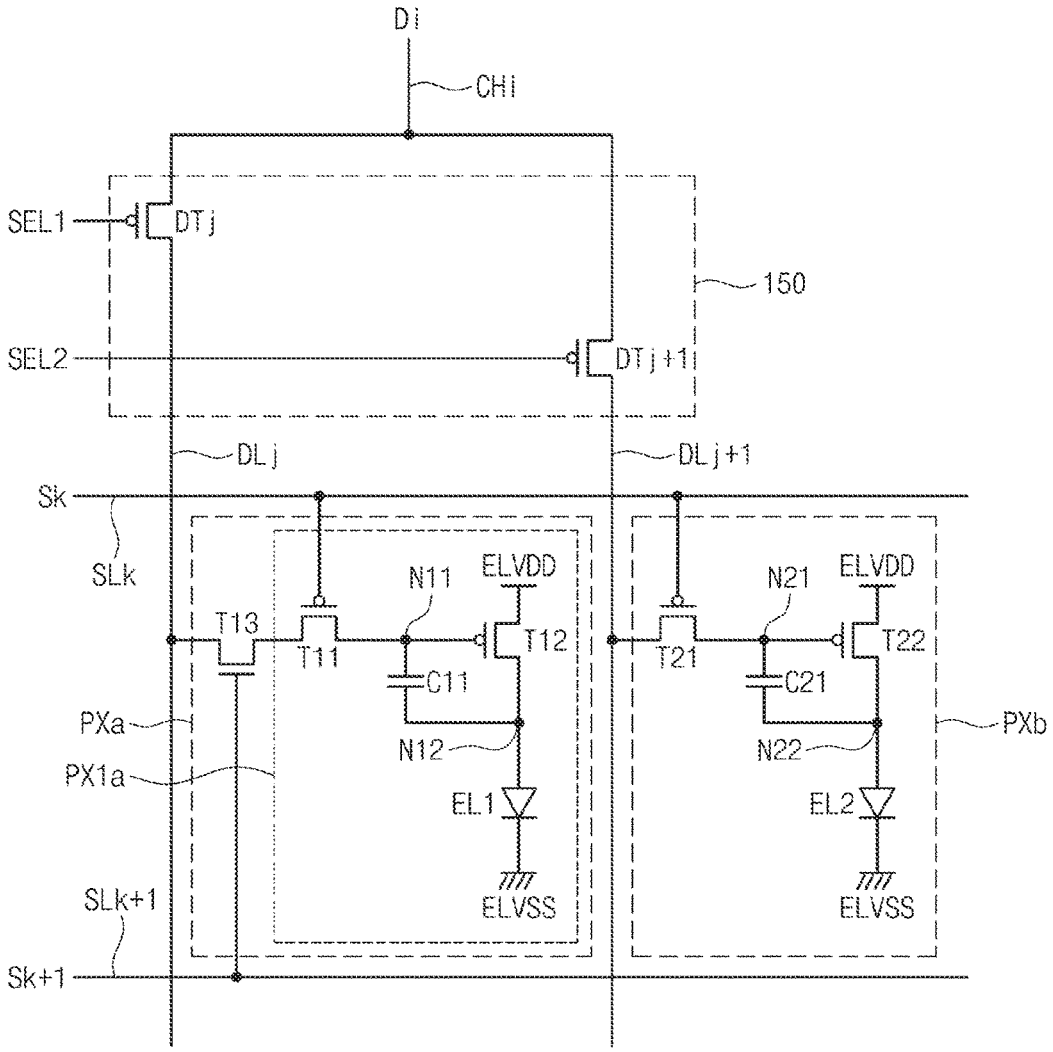
FIG. 2 is a circuit diagram showing a pixel according to an exemplary embodiment of the present disclosure.

FIG. 2 is a circuit diagram showing the first and second pixels PXa and PXb according to an exemplary embodiment of the present disclosure.

Referring to FIG. 2, the selection circuit 150 includes transistors DTj and DTj+1. The transistor DTj includes a first electrode connected to an i-th channel CHi, a second electrode connected to a j-th data line DLj, and a gate electrode connected to receive the first selection signal SEL1. The transistor DTj+1 includes a first electrode connected to the i-th channel CHi, a second electrode connected to a (j+1)th data line DLj+1, and a gate electrode connected to receive the second selection signal SEL2. Here, each of "i" and "j" is a positive integer number.

The first pixel PXa is connected to a k-th scan line SLk, a (k+1)th scan line SLk+1, and the j-th data line DLj (k is a positive integer number). The second pixel PXb is connected to the k-th scan line SLk and the (j+1)th data line DLj+1.

The first pixel PXa includes a first switching transistor T13 and a first pixel circuit PX1*a*. The first switching transistor T13 is connected to the (k+1)th scan line SLk+1. The first switching transistor T13 provides a data signal Di, sometime called a data output signal Di, from the j-th data line DLj to the first pixel circuit PX1*a* in response to the scan signal Sk+1 provided through the (k+1)th scan line SLk+1.

The first pixel circuit Px1*a* includes a first transistor T11, a second transistor T12, a capacitor C11, and an organic light emitting diode EL1. The first transistor T11 includes a first electrode connected to the first switching transistor T13, a second electrode connected to a first node N11, and a gate electrode connected to the k-th scan line SLk. The second transistor T12 includes a first electrode connected to the first power voltage ELVDD, a second electrode connected to a second node N12, and a gate electrode connected to the first node N11. The capacitor C11 is connected to and between the first node N11 and the second node N12.

The organic light emitting diode EL1 includes an anode electrode connected to the second node N12 and a cathode electrode receiving the second power voltage ELVSS. The organic light emitting diode EL1 may include an organic light emitting layer formed between the cathode electrode and the anode electrode. The organic light emitting layer may include a hole transport layer, a light emitting layer, and an electron transport layer.

The first switching transistor T13 includes a first electrode connected to the j-th data line DLj, a second electrode connected to the first electrode of the first transistor T11 of the first pixel circuit PX1*a*, and a gate electrode connected to the (k+1)th scan line SLk+1.

When each of the first and second transistors T11 and T12 is a PMOS transistor, the first switching transistor T13 is an NMOS transistor.

When the first switching transistor T13 and the first transistor T11 are turned on and the data signal Di provided from the j-th data line DLj is applied to the first node N11, the second transistor T12 may be turned on. Accordingly, an amount of a current flowing through the organic light emitting diode EL1 is controlled by the data signal Di, and thus a grayscale of the image may be displayed. The capacitor C11 maintains the data signal Di applied to the gate electrode of the second transistor T12 during one frame.

The second pixel PXb includes a first transistor T21, a second transistor T22, a capacitor C21, and an organic light emitting diode EL2. The first transistor T21 includes a first electrode connected to the (j+1)th data line DLj+1, a second electrode connected to a first node N21, and a gate electrode connected to the k-th scan line SLk. The second transistor T22 includes a first electrode connected to the first power voltage ELVDD, a second electrode connected to a second node N22, and a gate electrode connected to the first node N21. The capacitor C21 is connected to and between the first node N21 and the second node N22. The organic light emitting diode EL2 includes one end connected to the second node N22 and the other end receiving the second power voltage ELVSS. Each of the first transistor T21 and the second transistor T22 is the PMOS transistor.

Figure 3:
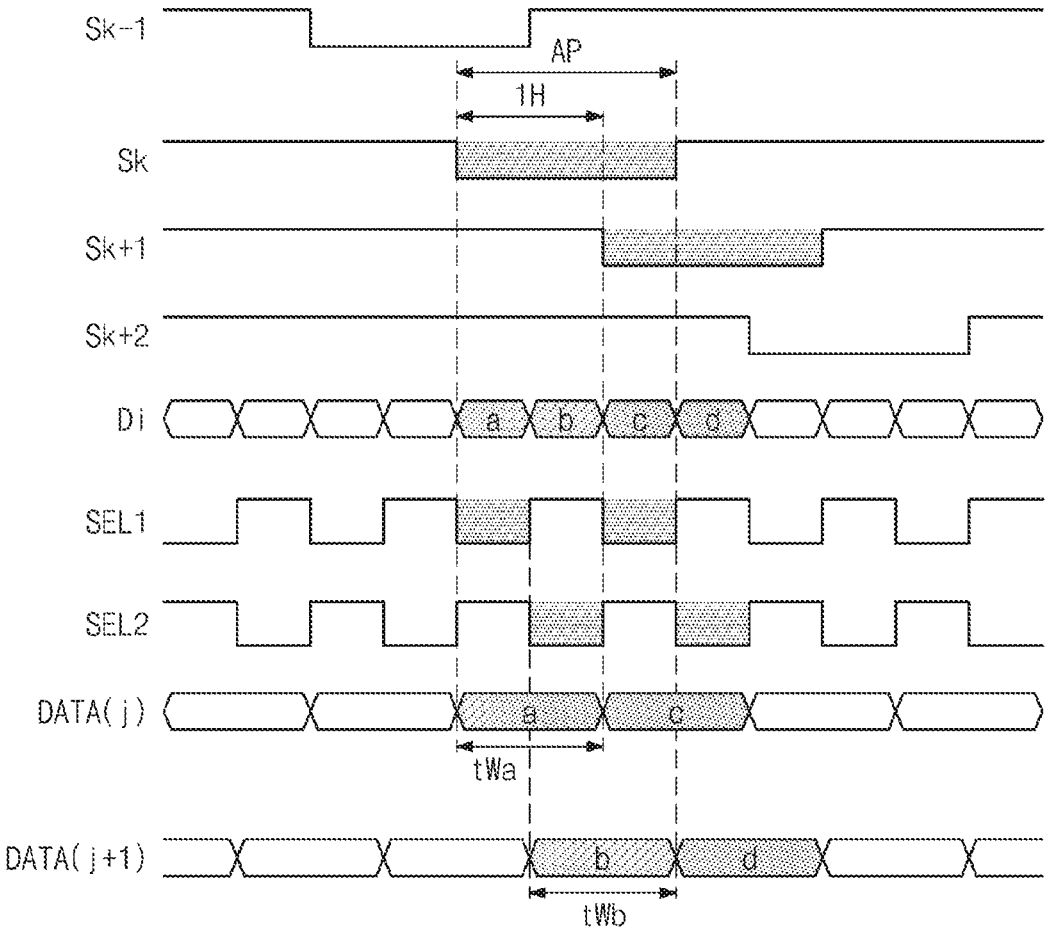
FIG. 3 is a timing diagram explaining an operation of the display apparatus including the pixel shown in FIG. 2.

FIG. 3 is a timing diagram explaining an operation of the display apparatus including the pixel shown in FIG. 2.

Referring to FIGS. 2 and 3, the scan signal Sk applied to the k-th scan line SLk and the scan signal Sk+1 applied to the (k+1)th scan line SLk+1 are sequentially activated to a low level. An active period AP of each of the scan signal Sk and the scan signal Sk+1 is longer than one horizontal period 1H. The one horizontal period 1H indicates a time period in which all pixels connected to one scan line of the display panel 110 shown in FIG. 1 are driven. That is, the one horizontal period 1H indicates a time during which the data signals D1 to Dw are provided to the channels CH1 to CHw by the data driving circuit 140.

The active period AP of the scan signal Sk partially overlaps with the active period AP of the scan signal Sk+1. In the embodiment shown in FIG. 3, the active period AP of each of the scan signal Sk and the scan signal Sk+1 is about 1.5H, and the active period AP of the scan signal Sk overlaps with the active period AP of the scan signal Sk+1 during about 0.5H. However, the active period AP of each of the scan signal Sk and the scan signal Sk+1 should not be limited thereto or thereby.

The first selection signal SEL1 and the second selection signal SEL2 are signals complementary to each other. For instance, when the first selection signal SEL1 has a high level, the second selection signal SEL2 has a low level, and when the first selection signal SEL1 has the low level, the second selection signal SEL2 has the high level. During the low level of the first selection signal SEL1, the data signal Di is provided to the data line DLj through the transistor DTj. During the low level of the second selection signal SEL2, the data signal Di is provided to the data line DLj+1 through the transistor DTj+1. The data signal Di transmitted through the channel CHi may be sequentially provided to the data lines DLj and DLj+1 through the selection circuit 150.

When the scan signal Sk has the low level and the scan signal Sk+1 has the high level, the first switching transistor T13 and the first transistor T11 are turned on. In this case, the data signal Di transmitted to the j-th data line DLj through the transistor DTj is provided to the first node N11 through the first switching transistor T13 and the first transistor T11, and thus the organic light emitting diode EL1 emits a light.

Since a period in which the scan signal Sk has the low level and the scan signal Sk+1 has the high level corresponds to the time of the one horizontal period 1H, a data write time tWa in which a data signal DATA(j) is provided to the first node N11 of the first pixel PXa may be obtained by the one horizontal period 1H. When the scan signal Sk+1 is transitioned to the low level, the first switching transistor T13 is turned off.

When the transistor DTj+1 of the selection circuit 150 is turned on in response to the second selection signal SEL2, the data signal Di is provided to the (j+1)th data line DLj+1. The organic light emitting diode EL2 emits the light by the data signal Di transmitted through the first transistor T21 after the first transistor T21 of the second pixel PXb is turned on during the low level of the scan signal Sk.

A data write time tWb in which a data signal DATA(j+1) is provided to the first node N21 of the second pixel PXb from a time point at which the second selection signal SEL2 is transitioned to the low level to a time point at which the scan signal Sk is transitioned to the high level may be obtained by the one horizontal period 1H. When the scan signal Sk is transitioned to the high level, the first transistor T21 is turned off.

As described above, each of the data write time tWa of the first pixel PXa and the data write time tWb of the second pixel PXb may be obtained by a time corresponding to the one horizontal period 1H, and thus a decrease in a pixel charge may be minimized.

Figure 4:
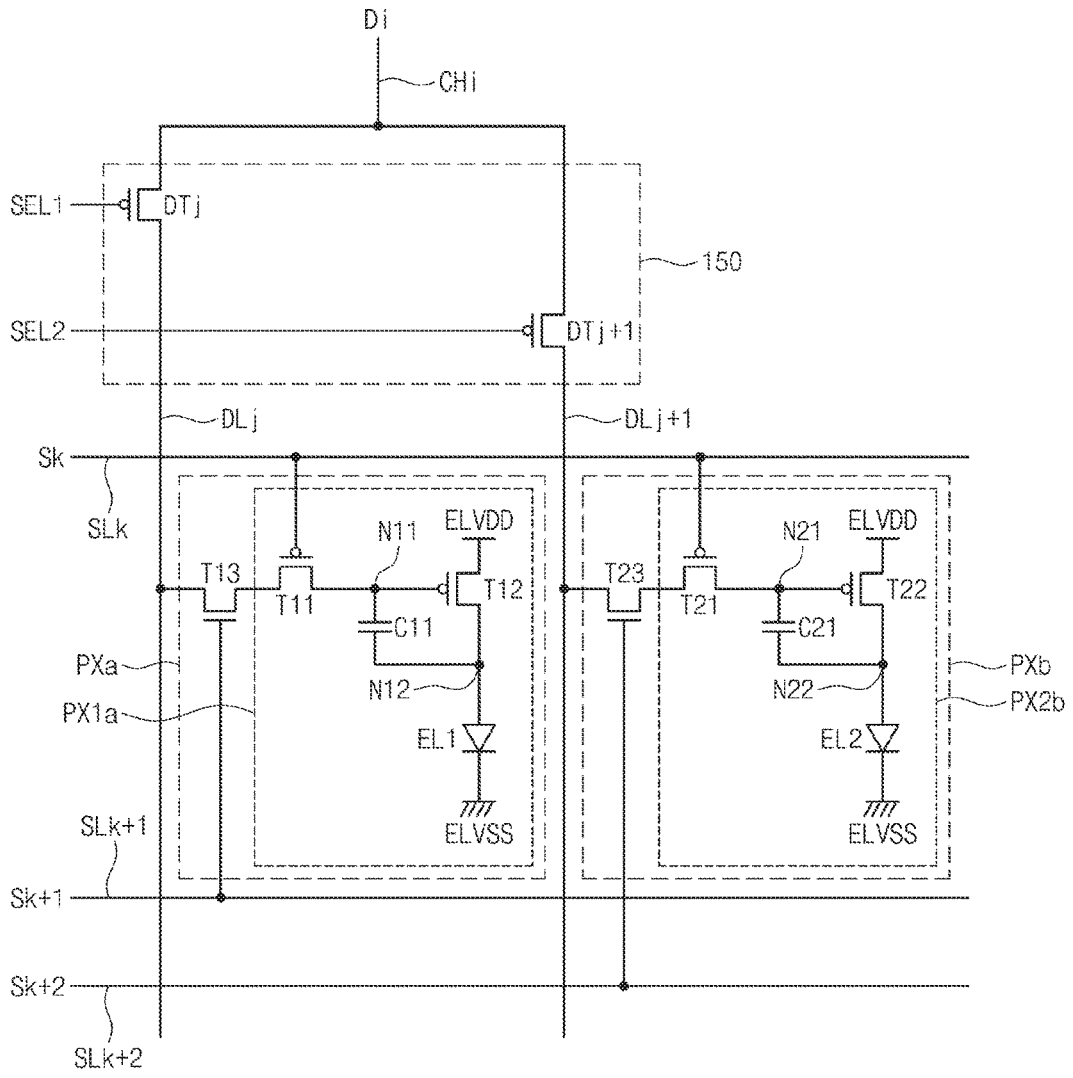
FIG. 4 is a circuit diagram showing first and second pixels according to another exemplary embodiment of the present disclosure.

FIG. 4 is a circuit diagram showing first and second pixels PXa and PXb according to another exemplary embodiment of the present disclosure.

Referring to FIG. 4, since a selection circuit 150 and a first pixel PXa have the same circuit configuration as those of the selection circuit 150 and the first pixel PXa shown in FIG. 2, the selection circuit 150 and the first pixel PXa are assigned with the same reference numerals and details thereof will be omitted.

A second pixel PXb includes a second switching transistor T23 and a second pixel circuit PX2*b*. The second switching transistor T23 is connected to a (k+2)th scan line SLk+2. The second switching transistor T23 applies the data signal Di from the (j+1)th data line DI j+1 to the second pixel circuit PX2*b* in response to a scan signal Sk+2 provided through the (k+2)th scan line SLk+2.

The second pixel circuit PX2*b* includes a first transistor T21, a second transistor T22, a capacitor C21, and an organic light emitting diode EL2. The first transistor T21 includes a first electrode connected to the second switching transistor T23, a second electrode connected to a first node N21, and a gate electrode connected to a k-th scan line SLk. The second transistor T22 includes a first electrode connected to the first power voltage ELVDD, a second electrode connected to a second node N22, and a gate electrode connected to the first node N21. The capacitor C21 is connected to and between the first node N21 and the second node N22. The organic light emitting diode EL2 includes one end connected to the second node N22 and the other end connected to the second power voltage ELVSS.

The second switching transistor T23 includes a first electrode connected to the (j+1)th data line DLj+1, a second electrode connected to the first electrode of the first transistor T21 of the second pixel circuit PX2*b*, and a gate electrode connected to the (k+2)th scan line SLk+2. When each of the first and second transistors T21 and T22 is a PMOS transistor, the second switching transistor T23 is an NMOS transistor.

Figure 5:
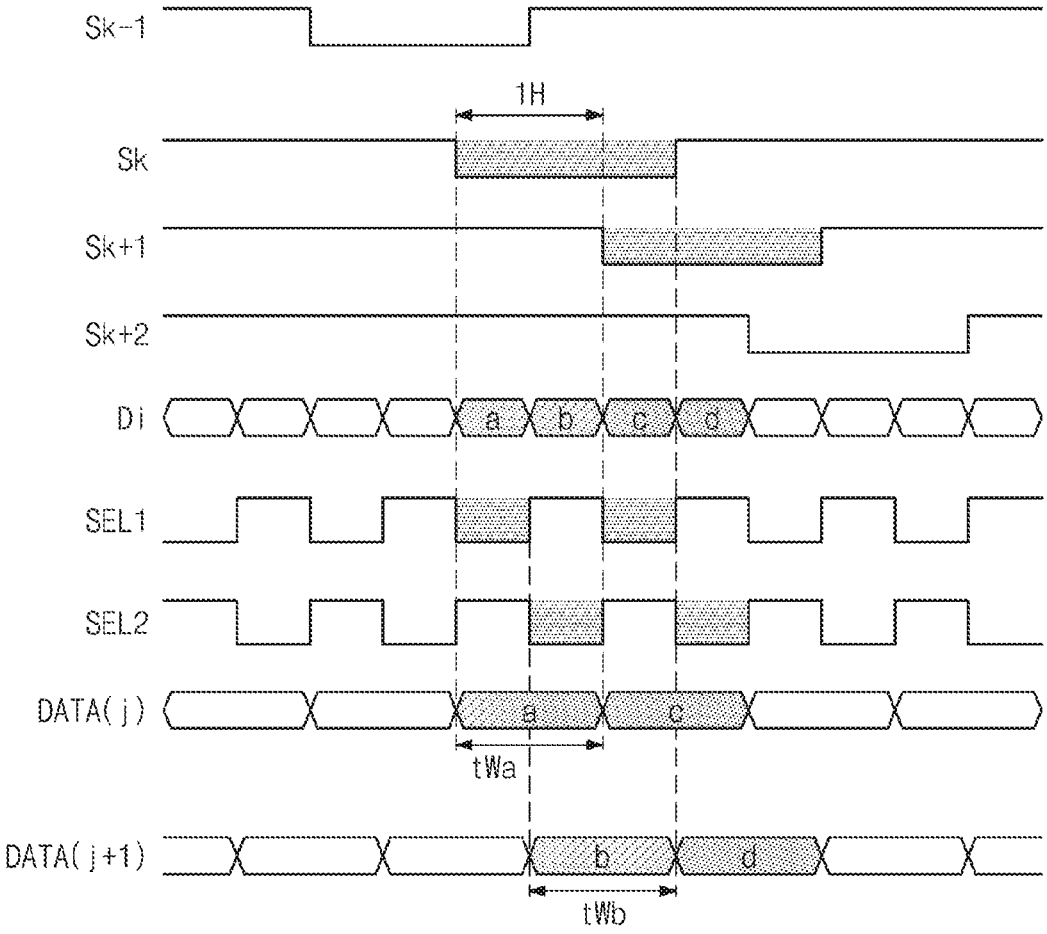
FIG. 5 is a timing diagram explaining an operation of a display apparatus including the first and second pixels shown in FIG. 4.

FIG. 5 is a timing diagram explaining an operation of a display apparatus including the first and second pixels PXa and PXb shown in FIG. 4.

Referring to FIGS. 4 and 5, the scan signal Sk applied to the k-th scan line SLk and the scan signal Sk+1 applied to the (k+1)th scan line SLk+1 are sequentially activated to a low level. An active period AP of each of the scan signal Sk and the scan signal Sk+1 is longer than one horizontal period 1H. The one horizontal period 1H indicates a time period in which all pixels connected to one scan line of the display panel 110 shown in FIG. 1 are driven. That is, the one horizontal period 1H indicates a time during which the data signals D1 to Dw are provided to the channels CH1 to CHw by the data driving circuit 140.

When the scan signal Sk has the low level and the scan signal Sk+1 has the high level, a first switching transistor T13 and a first transistor T11 are turned on. In this case, the data signal Di transmitted to a j-th data line DLj through a transistor DTj is provided to the first node N11 through the first switching transistor T13 and the first transistor T11, and thus the organic light emitting diode EL1 emits the light.

Since a period in which the scan signal Sk has the low level and the scan signal Sk+1 has the high level corresponds to the time of the one horizontal period 1H, the data write time tWa in which the data signal DATA(j) is provided to the first node N11 of the first pixel PXa may be obtained by the one horizontal period 1H. When the scan signal Sk+1 is transitioned to the low level, the first switching transistor T13 is turned off.

When the scan signal Sk has the low level and a third scan signal Sk+2 has the high level, the second switching transistor T23 and the first transistor T21 are turned on. A period in which the scan signal Sk has the low level and the third scan signal Sk+2 has the high level corresponds to a time period of about 1.5 horizontal period (1.5H). When the transistor DTj+1 of the selection circuit 150 is turned on in response to the second selection signal SEL2, the data signal Di is provided to the first node N21 through the (j+1)th data line DLj+1, the second switching transistor T23, and the first transistor T21. A data write time tWb in which the data signal DATA(j+1) is provided to the first node N21 of the second pixel PXb from a time point at which the second selection signal SEL2 is transitioned to the low level to a time point at which the scan signal Sk is transitioned to the high level may be obtained by the one horizontal period 1H. When the scan signal Sk is transitioned to the high level, the first transistor T21 is turned off.

As described above, each of the data write time tWa of the first pixel PXa and the data write time tWb of the second pixel PXb may be obtained by a time corresponding to the one horizontal period 1H, and thus a decrease in a pixel charge rate may be minimized.

Figure 6:
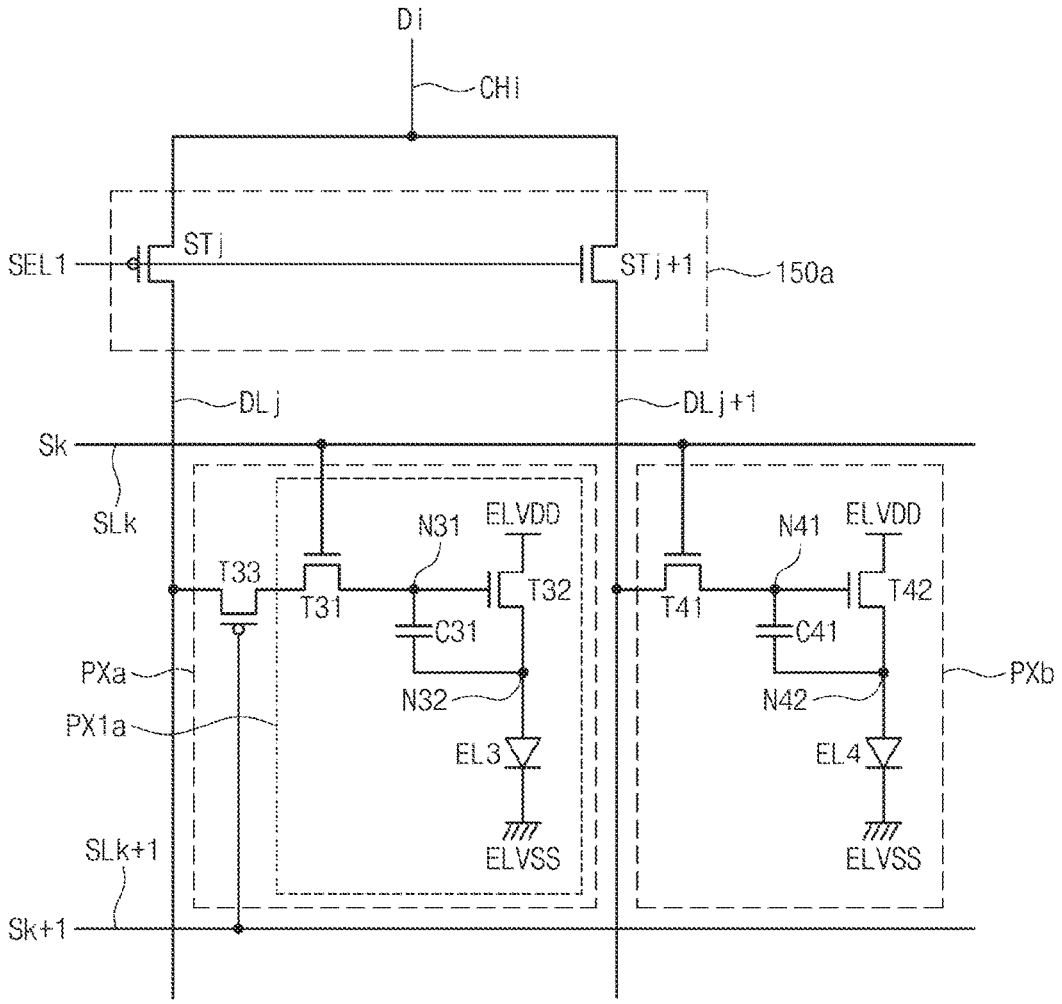
FIG. 6 is a circuit diagram showing a selection circuit and first and second pixels according to another exemplary embodiment of the present disclosure.

FIG. 6 is a circuit diagram showing a selection circuit 150*a* and first and second pixels Pxa and PXb according to another exemplary embodiment of the present disclosure.

Referring to FIG. 6, the selection circuit 150*a* includes transistors STj and STj+1. The transistor STj is a PMOS transistor, and the transistor STj+1 is an NMOS transistor. The transistors STj and STj+1 electrically connect the channel CHi to one of the data lines DLj and DLj+1 in response to the first selection signal SEL1. For instance, when the first selection signal SEL1 has the low level, the transistor STj is turned on, and the data signal Di provided through the channel CHi is provided to the data line DLj. When the first selection signal SEL1 has the high level, the transistor STj+1 is turned on, and the data signal Di provided through the channel CHi is provided to the data line DLj+1.

The first pixel PXa is connected to the k-th scan line SLk, the (k+1)th scan line SLk+1, and the j-th data line DLj (k is a positive integer number). The second pixel PXb is connected to the k-th scan line SLk and the (j+1)th data line DLj+1.

The first pixel PXa includes a first switching transistor T33 and a first pixel circuit PX1*a*. The first pixel circuit PX1*a* includes a first transistor T31, a second transistor T32, a capacitor C31, and an organic light emitting diode EL3. When each of the first transistor T31 and the second transistor T32 is an NMOS transistor, the first switching transistor T33 is a PMOS transistor.

The second pixel PXb includes a first transistor T41, a second transistor T42, a capacitor C41, and an organic light emitting diode EL4. Each of the first transistor T41 and the second transistor T42 is an NMOS transistor.

Figure 7:
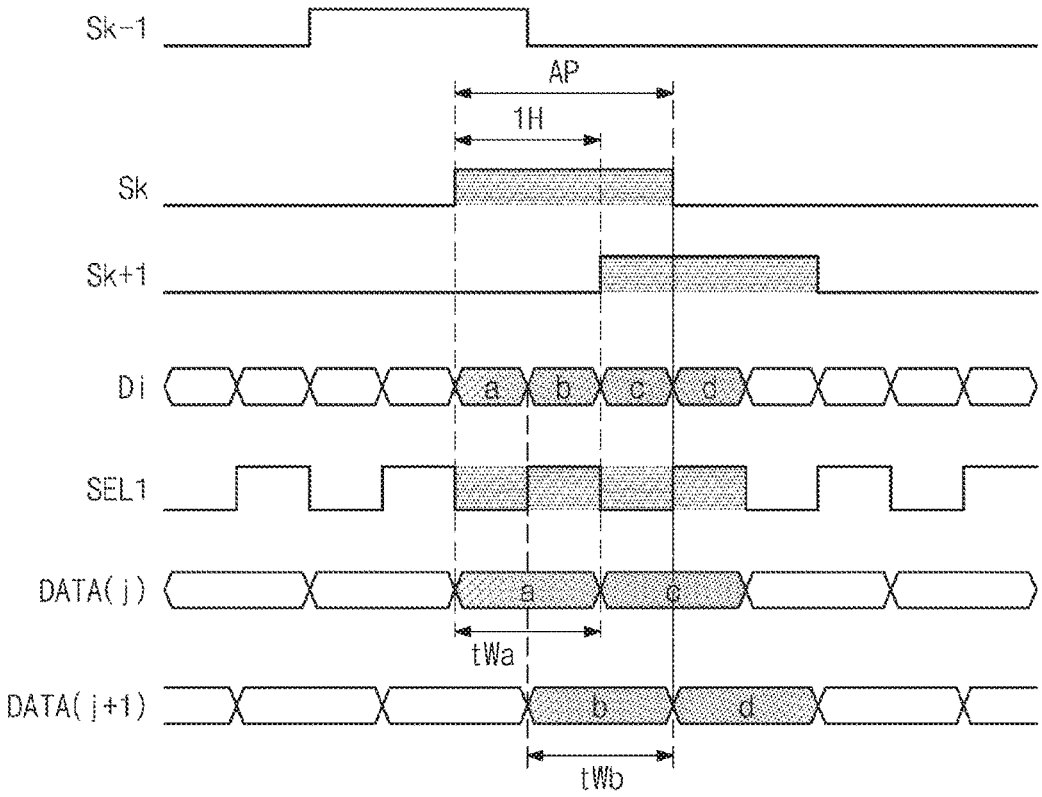
FIG. 7 is a timing diagram explaining an operation of a display apparatus including the first and second pixels shown in FIG. 6.

FIG. 7 is a timing diagram explaining an operation of a display apparatus including the first and second pixels Pxa and PXb shown in FIG. 6.

Referring to FIGS. 6 and 7, the scan signal Sk applied to the k-th scan line SLk and the scan signal Sk+1 applied to the (k+1)th scan line SLk+1 are sequentially activated to the high level. An active period AP of each of the scan signal Sk and the scan signal Sk+1 is longer than one horizontal period 1H. The one horizontal period 1H indicates a time in which all pixels connected to one scan line of the display panel 110 shown in FIG. 1 are driven. That is, the one horizontal period 1H indicates a time during which the data signals D1 to Dw are provided to the channels CH1 to CHw by the data driving circuit 140.

The active period AP of the scan signal Sk partially overlaps with the active period AP of the scan signal Sk+1. In the embodiment shown in FIG. 6, the active period AP of each of the scan signal Sk and the scan signal Sk+1 is about 1.5H, and the active period AP of the scan signal Sk overlaps with the active period AP of the scan signal Sk+1 during about 0.5H. However, the active period AP of each of the scan signal Sk and the scan signal Sk+1 should not be limited thereto or thereby.

The data signal Di is provided to the data line DLj through the transistor STj during the low level of the first selection signal SEL1. The data signal Di is provided to the data line DLj+1 through the transistor STj+1 during the high level of the first selection signal SEL1.

Since a period in which the scan signal Sk has the high level and the scan signal Sk+1 has the low level corresponds to the time of the one horizontal period 1H, a data write time tWa in which the data signal DATA(j) is provided to the first node N31 of the first pixel PXa may be obtained by the one horizontal period 1H. When the scan signal Sk+1 is transitioned to the low level, the first switching transistor T33 is turned off.

A data write time tWb in which the data signal DATA(j+1) is provided to the first node N41 of the second pixel PXb from a time point at which the first selection signal SEL1 is transitioned to the high level to a time point at which the scan signal Sk is transitioned to the low level may be obtained by the one horizontal period 1H. When the scan signal Sk is transitioned to the high level, the first transistor T41 is turned off.

As described above, each of the data write time tWa of the first pixel PXa and the data write time tWb of the second pixel PXb may be obtained by a time corresponding to the one horizontal period 1H, and thus a decrease in a pixel charge may be minimized.

Figure 8:
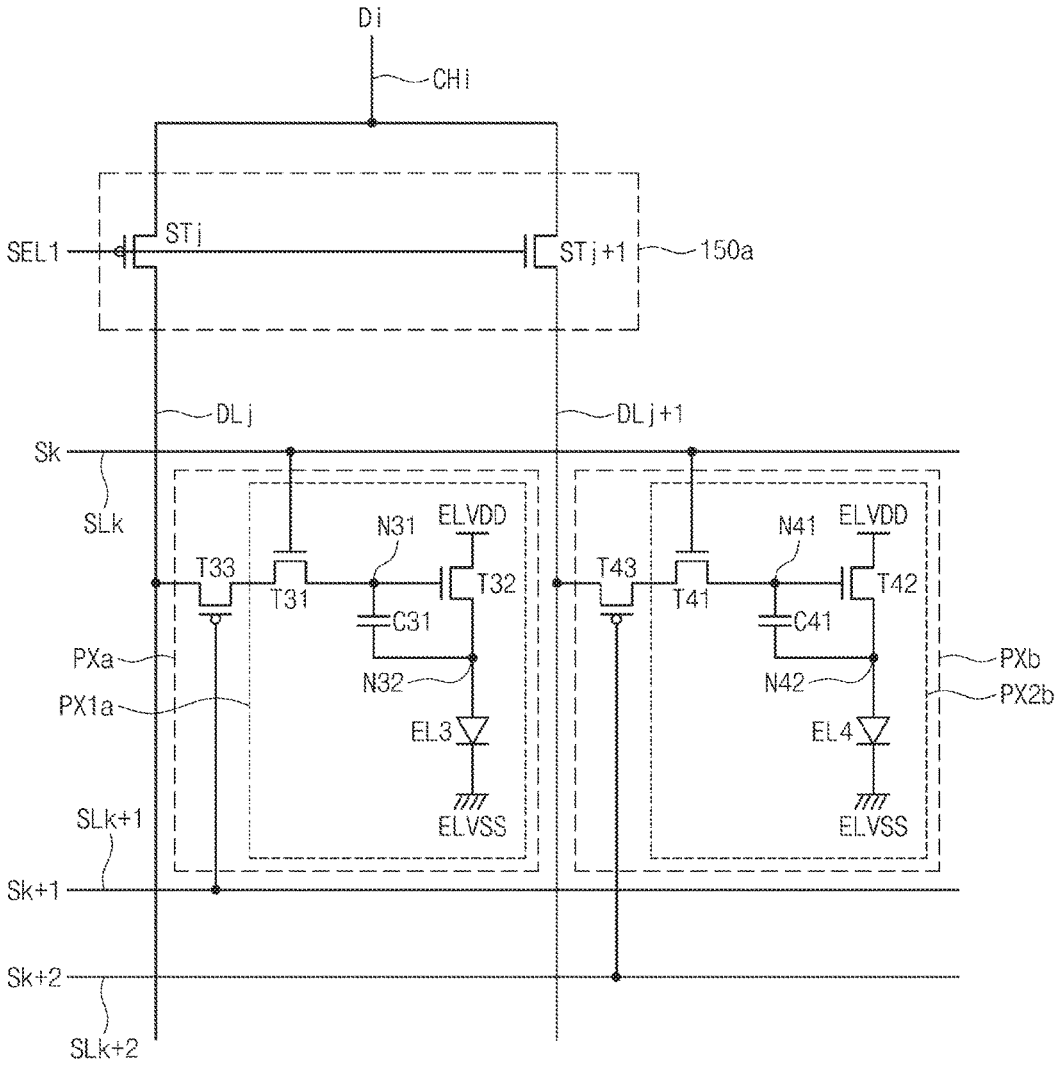
FIG. 8 is a circuit diagram showing first and second pixels according to another exemplary embodiment of the present disclosure.

FIG. 8 is a circuit diagram showing first and second pixels PXa and PXb according to another exemplary embodiment of the present disclosure.

Referring to FIG. 8, since a selection circuit 150*a* and a first pixel PXa have the same circuit configuration as those of the selection circuit 150*a* and the first pixel PXa shown in FIG. 6, the selection circuit 150*a* and the first pixel PXa are assigned with the same reference numerals, and details thereof will be omitted.

A second pixel PXb includes a second switching transistor T43 and a second pixel circuit PX2*b*. The second switching transistor T43 is connected to a (k+2)th scan line SLk+2. The second switching transistor T43 applies the data signal Di from the (j+1)th data line DLj+1 to the second pixel circuit PX2*b* in response to the scan signal Sk+2 provided through the (k+2)th scan line SLk+2.

The second pixel circuit PX2*b* includes a first transistor T41, a second transistor T42, a capacitor C41, and an organic light emitting diode EL4. The first transistor T41 includes a first electrode connected to the second switching transistor T43, a second electrode connected to the first node N41, and a gate electrode connected to the k-th scan line SLk. The second transistor T42 includes a first electrode connected to the first power voltage ELVDD, a second electrode connected to the second node N42, and a gate electrode connected to the first node N41. The capacitor C41 is connected to and between the first node N41 and the second node N42. The organic light emitting diode EL4 includes one end connected to the second node N42 and the other end connected to the second power voltage ELVSS.

The second switching transistor T43 includes a first electrode connected to the (j+1)th data line DLj+1, a second electrode connected to the first electrode of the first transistor T41 of the second pixel circuit PX2*b*, and a gate electrode connected to the (k+2)th scan line SLk+2. When each of the first and second transistors T41 and T42 is an NMOS transistor, the second switching transistor T43 is a PMOS transistor.

Figure 9:
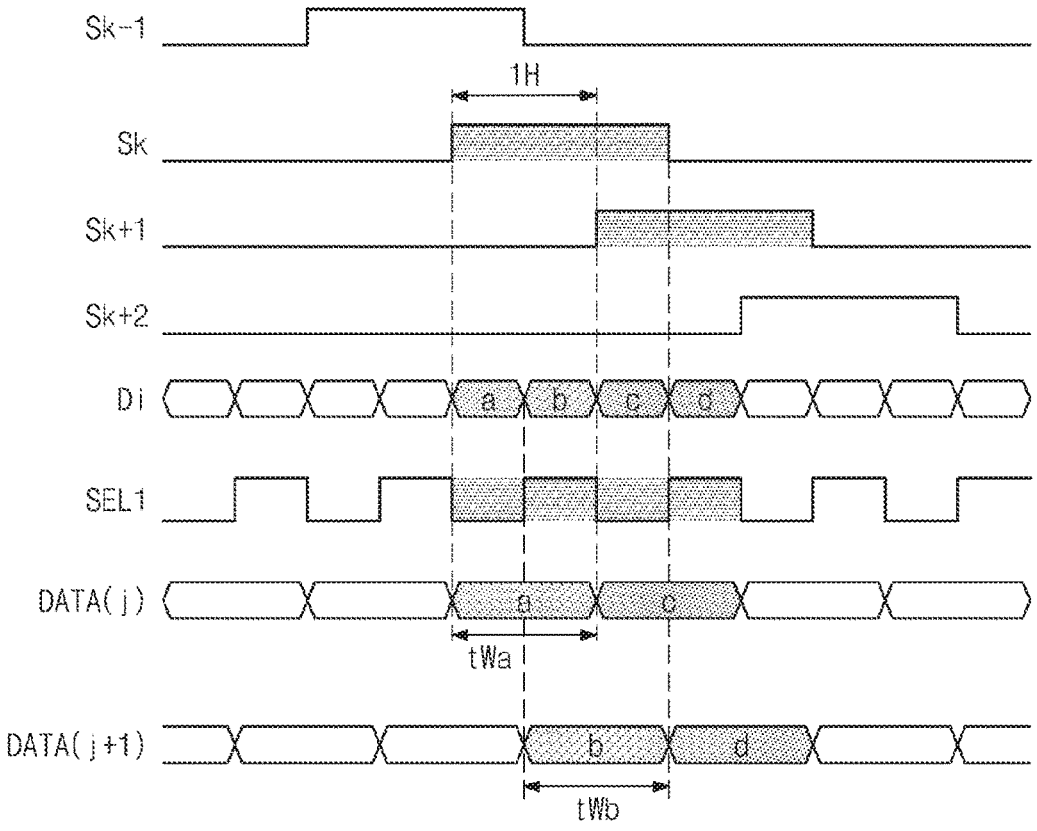
FIG. 9 is a timing diagram explaining an operation of a display apparatus including the first and second pixels shown in FIG. 8.

FIG. 9 is a timing diagram explaining an operation of a display apparatus including the first and second pixels PXa and PXb shown in FIG. 8.

Referring to FIGS. 8 and 9, the scan signal Sk applied to the k-th scan line SLk and the scan signal Sk+1 applied to the (k+1)th scan line SLk+1 are sequentially activated to a high level. An active period AP of each of the scan signal Sk and the scan signal Sk+1 is longer than one horizontal period 1H. The one horizontal period 1H indicates a time in which all pixels connected to one scan line of the display panel 110 shown in FIG. 1 are driven.

The data signal Di is provided to the data line DLj through the transistor STj during a low level of the first selection signal SEL1. The data signal Di is provided to the data line DLj+1 through the transistor STj+1 during the high level of the first selection signal SEL1. The data signal Di transmitted through the channel CHi may be sequentially provided to the data lines DLj and DLj+1 through the selection circuit 150*a*.

Since a period in which the scan signal Sk has the high level and the scan signal Sk+1 has the low level corresponds to the time of the one horizontal period 1H, a data write time tWa in which the data signal DATA(j) is provided to the first node N31 of the first pixel PXa may be obtained by the one horizontal period 1H. When the scan signal Sk+1 is transitioned to the low level, the first switching transistor T33 is turned off.

When the scan signal Sk has the high level and a third scan signal Sk+2 has the low level, the second switching transistor T43 and the first transistor T41 are turned on. A period in which the scan signal Sk has the high level and the third scan signal Sk+2 has the low level corresponds to a time period of about 1.5 horizontal period (1.5H). When the transistor STj+1 of the selection circuit 150*a* is turned on in response to the first selection signal SEL1 having the high level, the data signal Di is provided to the first node N41 through the (j+1)th data line DLj+1, the second switching transistor T43, and the first transistor T41. A data write time tWb in which the data signal DATA(j+1) is provided to the first node N41 of the second pixel PXb from a time point at which the first selection signal SEL1 is transitioned to the high level to a time point at which the scan signal Sk is transitioned to the low level may be obtained by the one horizontal period 1H. When the scan signal Sk is transitioned to the high level, the first transistor T41 is turned off.

As described above, each of the data write time tWa of the first pixel PXa and the data write time tWb of the second pixel PXb may be obtained by the time corresponding to the one horizontal period 1H, and thus a decrease in a pixel charge may be minimized.

Figure 10:
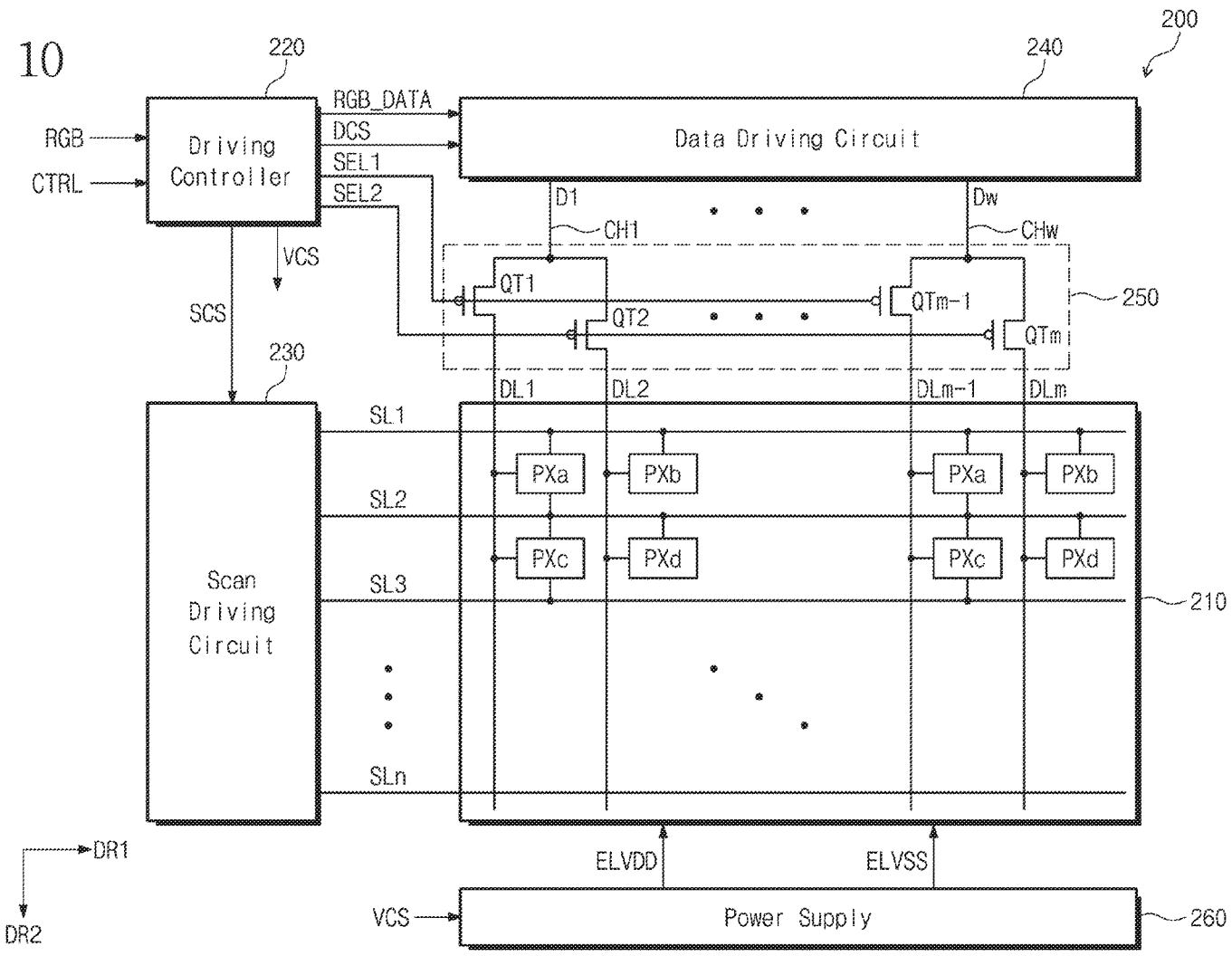
FIG. 10 is a block diagram showing a configuration of a display apparatus according to another exemplary embodiment of the present disclosure.

FIG. 10 is a block diagram showing a configuration of a display apparatus 200 according to another exemplary embodiment of the present disclosure.

Referring to FIG. 10, the display apparatus 200 includes a display panel 210, a driving controller 220, a scan driving circuit 230, a data driving circuit 240, a selection circuit 250, and a power supply 260.

The driving controller 220, the scan driving circuit 230, the data driving circuit 240, the selection circuit 250, and the power supply 260 shown in FIG. 10 have the same configuration and function as the driving controller 120, the scan driving circuit 130, the data driving circuit 140, the selection circuit 150, and the power supply 160 shown in FIG. 1, and thus details thereof will be omitted.

The display panel 210 includes a plurality of scan lines SL1 to SLn extending in a first direction DR1, a plurality of data lines DL1 to DLm extending in a second direction DR2, and a plurality of pixels PXa, PXb, PXc, and PXd respectively connected to the scan lines SL1 to SLn and the data lines DL1 to DLm. FIG. 10 shows some scan lines of the scan lines SL1 to SLn and some data lines of the data lines DL1 to DLm.

The pixels PXa, PXb, PXc, and PXd may be classified into a plurality of groups depending on a color displayed thereby. The pixels PXa, PXb, PXc, and PXd may display one of primary colors. The primary colors include a red color, a green color, a blue color, and a white color, but the primary colors should not be limited thereto or thereby. That is, the primary colors may further include a variety of colors, such as a yellow color, a cyan color, a magenta color, etc.

In the embodiment shown in FIG. 10, a first pixel PXa and a third pixel PXc are alternately and sequentially connected to odd-numbered data lines DL1, . . . , DLm−1, and a second pixel PXb and a fourth pixel PXd are alternately and sequentially connected to even-numbered data lines DL2, . . . , DLm. The first and third pixels PXa and PXc may further be connected to a scan line adjacent to the corresponding scan line in addition to the corresponding scan line. For instance, the first pixel PXa connected to a scan line SL1 and a data line DL1 is further connected to a scan line SL2 adjacent to the scan line SL1. The third pixel PXc connected to a scan line SL2 and a data line DL1 is further connected to a scan line SL3 adjacent to the scan line SL2.

Figure 11:
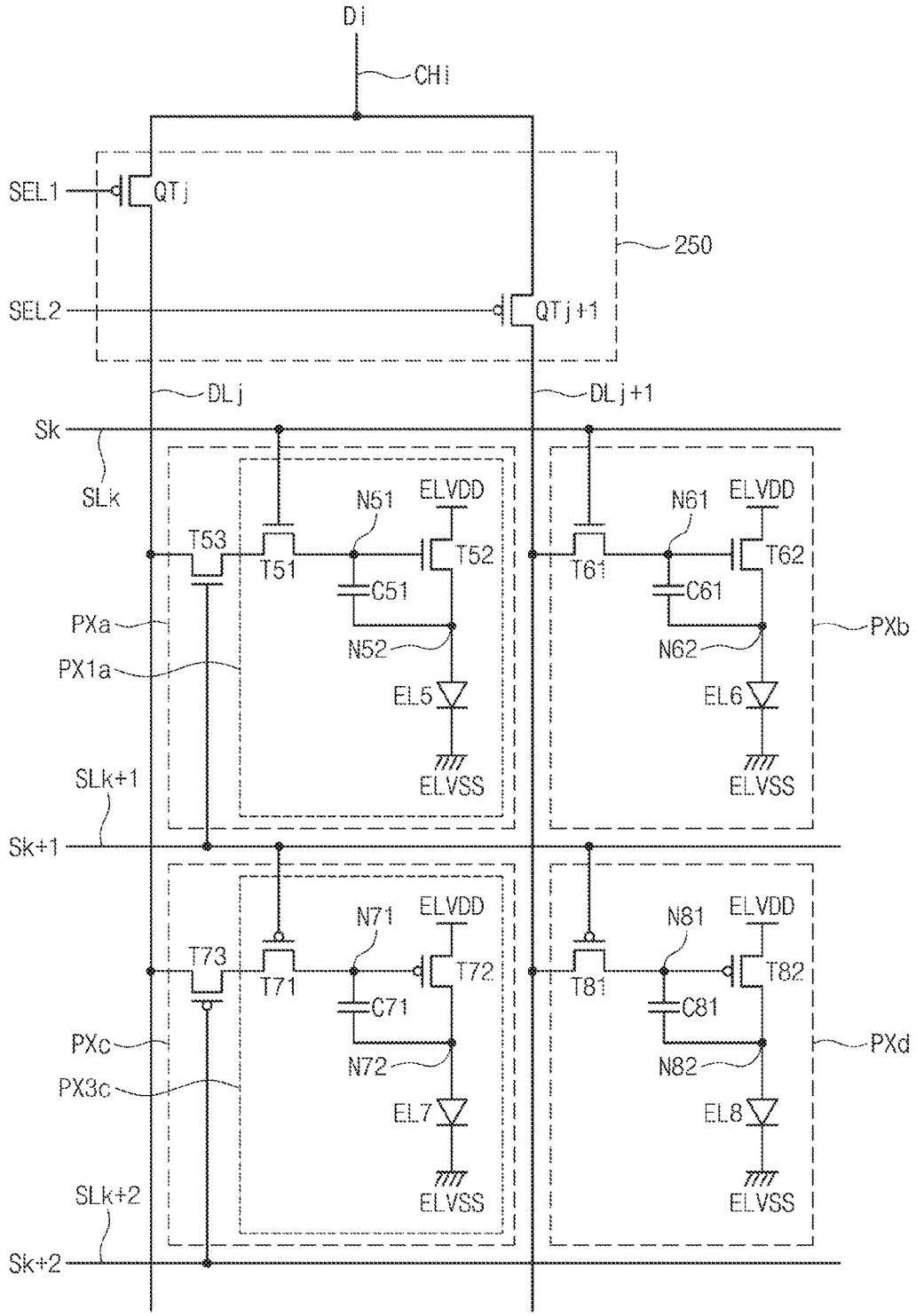
FIG. 11 is a circuit diagram showing first to fourth pixels according to another exemplary embodiment of the present disclosure.

FIG. 11 is a circuit diagram showing first to fourth pixels PXa and PXd according to another exemplary embodiment of the present disclosure.

Referring to FIG. 11, a selection circuit 250 includes transistors QTj and QTj+1. The transistor QTj includes a first electrode connected to the i-th channel CHi, a second electrode connected to the j-th data line DLj, and a gate electrode connected to the first selection signal SEL1. The transistor QTj+1 includes a first electrode connected to the i-th channel CHi, a second electrode connected to the (j+1)th data line DLj+1, and a gate electrode connected to the second selection signal SEL2. In the present exemplary embodiment, each of "i" and "j" is a positive integer number.

The first pixel PXa is connected to the k-th scan line SLk, the (k+1)th scan line SLk+1, and the j-th data line DLj (k is a positive integer number). The second pixel PXb is connected to the k-th scan line SLk and the (j+1)th data line DLj+1. The third pixel PXc is connected to the (k+1)th scan line SLk+1, the (k+2)th scan line SLk+2, and the j-th data line DLj (k is a positive integer number). The fourth pixel PXd is connected to the (k+1)th scan line SLk+1 and the (j+1)th data line DLj+1.

The first pixel PXa includes a first switching transistor T53 and a first pixel circuit PX1*a*. The first switching transistor T53 is connected to the (k+1)th scan line SLk+1. The first switching transistor T53 provides the data signal Di from the j-th data line DLj to the first pixel circuit PX1*a* in response to the scan signal Sk+1 provided through the (k+1)th scan line SLk+1.

The first pixel circuit PX1*a* includes a first transistor T51, a second transistor T52, a capacitor C51, and an organic light emitting diode EL5. The first transistor T51 includes a first electrode connected to the first switching transistor T53, a second electrode connected to a first node N51, and a gate electrode connected to the k-th scan line SLk. The second transistor T52 includes a first electrode connected to the first power voltage ELVDD, a second electrode connected to a second node N52, and a gate electrode connected to the first node N51. The capacitor C51 is connected to and between the first node N51 and the second node N52.

The first switching transistor T53 includes a first electrode connected to the j-th data line DLj, a second electrode connected to the first electrode of the first transistor T51 of the first pixel circuit PX1*a*, and a gate electrode connected to the (k+1)th scan line SLk+1.

Each of the first transistor T51, the second transistor T52, and the first switching transistor T53 is an NMOS transistor.

The second pixel PXb includes a first transistor T61, a second transistor T62, a capacitor C61, and an organic light emitting diode EL6. The first transistor T61 includes a first electrode connected to the (j+1)th data line DLj+1, a second electrode connected to a first node N61, and a gate electrode connected to the k-th scan line SLk. The second transistor T62 includes a first electrode connected to the first power voltage ELVDD, a second electrode connected to a second node N62, and a gate electrode connected to the first node N61. The capacitor C61 is connected to and between the first node N61 and the second node N62. The organic light emitting diode EL6 includes one end connected to the second node N62 and the other end receiving the second power voltage ELVSS. Each of the first and second transistors T61 and T62 is an NMOS transistor.

The third pixel PXc includes a first switching transistor T73 and a third pixel circuit PX3*c*. The first switching transistor T73 is connected to the (k+2)th scan line SLk+2. The first switching transistor T73 provides the data signal Di from the j-th data line DLj to the third pixel circuit PX3*c* in response to the scan signal Sk+2 provided through the (k+2)th scan line SLk+2.

The third pixel circuit PX3*c* includes a first transistor T71, a second transistor T72, a capacitor C71, and an organic light emitting diode EL7. The first transistor T71 includes a first electrode connected to the first switching transistor T73, a second electrode connected to a first node N71, and a gate electrode connected to the (k+1)th scan line SLk+1. The second transistor T72 includes a first electrode connected to the first power voltage ELVDD, a second electrode connected to a second node N72, and a gate electrode connected to the first node N71. The capacitor C71 is connected to and between the first node N71 and the second node N72.

The first switching transistor T73 includes a first electrode connected to the j-th data line DLj, a second electrode connected to the first electrode of the first transistor T71 of the third pixel circuit PX3*c*, and a gate electrode connected to the (k+2)th scan line SLk+1.

Each of the first transistor T71, the second transistor T72, and the first switching transistor T73 is a PMOS transistor.

The fourth pixel PXd includes a first transistor T81, a second transistor T82, a capacitor C81, and an organic light emitting diode EL8. The first transistor T81 includes a first electrode connected to the (j+1)th data line DLj+1, a second electrode connected to a first node N81, and a gate electrode connected to the (k+1)th scan line SLk+1. The second transistor T82 includes a first electrode connected to the first power voltage ELVDD, a second electrode connected to a second node N82, and a gate electrode connected to the first node N81. The capacitor C81 is connected to and between the first node N81 and the second node N82. The organic light emitting diode EL8 includes one end connected to the second node N82 and the other end receiving the second power voltage ELVSS. Each of the first and second transistors T81 and 182 is a PMOS transistor.

Figure 12:
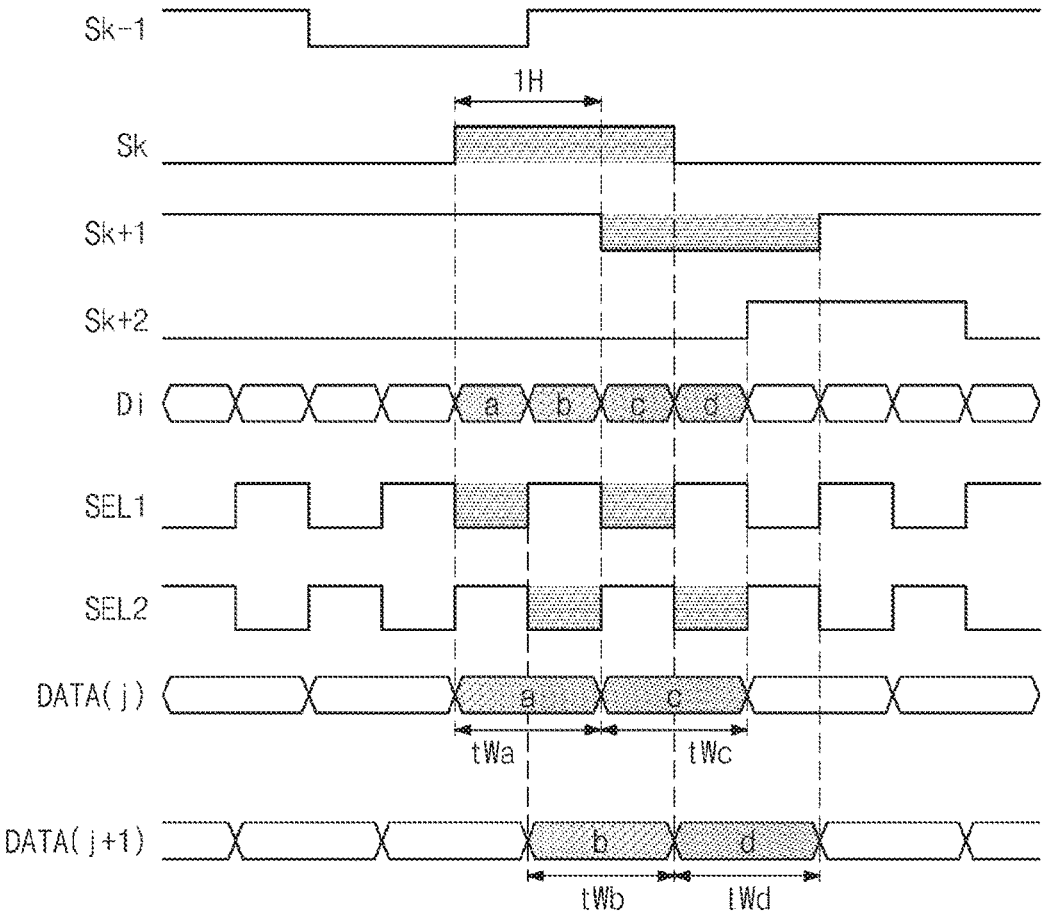
FIG. 12 is a timing diagram explaining an operation of a display apparatus including the first to fourth pixels shown in FIG. 11.

FIG. 12 is a timing diagram explaining an operation of a display apparatus including the first to fourth pixels PXa to PXd shown in FIG. 11.

Referring to FIGS. 11 and 12, the scan signals Sk−1 to Sk+2 applied to a (k−1)th scan line SLk−1 to the (k+2)th scan line SLk+2 are sequentially activated. The scan signal Sk−1 applied to the (k−1)th scan line SLk−1 and the scan signal Sk+1 applied to the (k+1)th scan line SLk+1 are sequentially activated to a low level. The scan signal Sk applied to the k-th scan line SLk and the scan signal Sk+2 applied to the (k+2)th scan line SLk+2 are sequentially activated to a high level.

For instance, since each of the first and second transistors T51 and T52 of the first pixel circuit PX1*a* and each of the first and second transistors T61 and T62 of the second pixel PXb, which are connected to the k-th scan line SLk, are the NMOS transistor, the scan signal Sk applied to the k-th scan line SLk is activated to the high level.

In addition, since each of the first and second transistors T71 and T72 of the third pixel circuit PX3*c* and each of the first and second transistors T81 and T82 of the fourth pixel PXd, which are connected to the (k+1)th scan line SLk+1, are the PMOS transistor, the scan signal Sk+1 applied to the (k+1)th scan line SLk+1 is activated to the low level. An active period of each of the scan signals Sk−1 to Sk+2 is longer than one horizontal period 1H.

Active periods of scan signals applied to scan lines adjacent to each other partially overlap with each other. For example, the active period AP of the scan signal Sk partially overlaps with the active period AP of the scan signal Sk+1.

The first selection signal SEL1 and the second selection signal SEL2 are signals complementary to each other. For instance, when the first selection signal SEL1 has a high level, the second selection signal SEL2 has a low level, and when the first selection signal SEL1 has the low level, the second selection signal SEL2 has the high level. During the low level of the first selection signal SEL1, the data signal Di is provided to the data line DLj through the transistor QTj. During the low level of the second selection signal SEL2, the data signal Di is provided to the data line DLj+1 through the transistor QTj+1. The data signal Di transmitted through the channel CHi may he sequentially provided to the data lines DLj and DLj+1 through the selection circuit 250.

When the scan signal Sk and the scan signal Sk+1 have the high level, the first switching transistor T53 and the first transistor T51 are turned on. In this case, the data signal Di transmitted to the j-th data line DLj through the transistor QTj is provided to the first node N51 through the first switching transistor T53 and the first transistor T51, and thus the organic light emitting diode EL5 emits a light.

Since a period in which the scan signal Sk and the scan signal Sk+1 have the high level corresponds to the time of the one horizontal period 1H, a data write time tWa in which the data signal DATA(j) is provided to the first node N51 of the first pixel PXa may be obtained by the one horizontal period 1H. When the scan signal Sk+1 is transitioned to the low level, the first switching transistor T53 is turned off.

When the transistor QTj+1 of the selection circuit 250 is turned on in response to the second selection signal SEL2, the data signal Di is provided to the (j+1)th data line DLj+1. The organic light emitting diode EL6 emits the light by the data signal Di transmitted through the first transistor T61 after the first transistor T61 of the second pixel PXb is turned on during the high level of the scan signal Sk.

A data write time tWb in which the data signal DATA(j+1) is provided to the first node N61 of the second pixel PXb from a time point at which the second selection signal SEL2 is transitioned to the low level to a time point at which the scan signal Sk is transitioned to the low level may be obtained by the one horizontal period 1H. When the scan signal Sk is transitioned to the low level, the first transistor T61 is turned off.

When the scan signal Sk+1 and the scan signal Sk+2 have the low level, the first switching transistor T73 and the first transistor T71 are turned on. In this case, the data signal Di transmitted to the j-th data line DLj through the transistor QTj is provided to the first node N71 through the first switching transistor T73 and the first transistor T71, and thus the organic light emitting diode EL7 emits a light.

Since a period in which the scan signal Sk+1 and the scan signal Sk+2 have the low level corresponds to the time of the one horizontal period 1H, a data write time tWc in which the data signal DATA(j) is provided to the first node N71 of the third pixel circuit PX3*c* may be obtained by the one horizontal period 1H. When the scan signal Sk+2 is transitioned to the high level, the first switching transistor T73 is turned off.

When the transistor QTj+1 of the selection circuit 250 is turned on in response to the second selection signal SEL2, the data signal Di is provided to the (j+1)th data line DLj+1. The organic light emitting diode EL8 emits the light by the data signal Di transmitted through the first transistor T81 after the first transistor T81 of the fourth pixel PXd is turned on during the low level of the scan signal Sk+1.

A data write time tWd in which the data signal DATA(j+1) is provided to the first node N81 of the fourth pixel PXd from a time point at which the second selection signal SEL2 is transitioned to the low level to a time point at which the scan signal Sk+1 is transitioned to the high level may be obtained by the one horizontal period 1H. When the scan signal Sk+1 is transitioned to the low level, the first transistor T81 is turned off.

As described above, each of the data write times tWa, tWb, tWc, and tWd of the first pixel PXa to the fourth pixel PXd may be obtained by a time corresponding to the one horizontal period 1H, and thus a decrease in a pixel charge may be minimized.

Although the exemplary embodiments have been described, it is understood that the inventive concept should not be limited to these exemplary embodiments but various changes and modifications can be made by one ordinary skilled in the art within the spirit and scope of the inventive concept as hereinafter claimed.

What is claimed is:

1. A display apparatus comprising:

a first pixel connected to a first scan line, a second scan line, and a first data line;

a second pixel connected to the first scan line and a second data line; and a selection circuit configured to electrically connect a first channel to one of the first data line and the second data line in response to selection signals, wherein a pulse width of a first scan signal configured to be provided to the first scan line and a pulse width of a second scan signal configured to be provided to the second scan line are longer than one horizontal period, wherein the first pixel comprises:

a first transistor comprising a first electrode, a second electrode connected to a first node, and a gate electrode connected to the first scan line;

a first light emitting unit connected to the first node, and configured to receive a first voltage and a second voltage and to emit a light; and a first switching transistor comprising a first electrode connected to the first data line, a second electrode connected to the first electrode of the first transistor, and a gate electrode connected to the second scan line, wherein one of the first transistor and the first switching transistor is a PMOS transistor, and the other is an NMOS transistor.

2. The display apparatus of claim 1, wherein the first scan signal and the second scan signal are configured to be sequentially activated, and an active period of the first scan signal partially overlaps with an active period of the second scan signal.

3. The display apparatus of claim 1, wherein the first light emitting unit comprises:

a second transistor comprising a first electrode configured to receive the first voltage, a second electrode connected to a second node, and a gate electrode connected to the first node;

a capacitor connected to and between the first node and the second node; and a first light emitting device comprising one end connected to the second node and the other end configured to receive the second voltage.

4. The display apparatus of claim 1, wherein the first transistor is a PMOS transistor, and the first switching transistor is an NMOS transistor.

5. The display apparatus of claim 1, wherein, when the second scan signal transmitted through the second scan line is inactive and the first scan signal transmitted through the first scan line is active, a first data signal transmitted through the first data line is provided to the first node.

6. The display apparatus of claim 5, wherein a period in which the second scan signal transmitted through the second scan line is inactive and the first scan signal transmitted through the first scan line is active is equal to the one horizontal period.

7. The display apparatus of claim 5, wherein, when the first scan signal transmitted through the first scan line is active, a second data signal transmitted through the second data line is provided to the second pixel.

8. The display apparatus of claim 1, wherein the first transistor is an NMOS transistor, and the first switching transistor is a PMOS transistor.

9. A display apparatus comprising:

a first pixel connected to a first scan line, a second scan line, and a first data line;

a second pixel connected to the first scan line and a second data line;

a third pixel connected to the second scan line, a third scan line, and the first data line; and a fourth pixel connected to the second scan line and the second data line, a selection circuit configured to electrically connect a first channel to one of the first data line and the second data line in response to selection signals, wherein the first pixel comprises:

a first transistor comprising a first electrode, a second electrode connected to a first node, and a gate electrode connected to the first scan line;

a first light emitting unit connected to the first node, and configured to receive a first voltage and a second voltage and to emit a light; and a first switching transistor comprising a first electrode connected to the first data line, a second electrode connected to the first electrode of the first transistor, and a gate electrode connected to the second scan line, wherein the third pixel comprises:

a third transistor comprising a first electrode, a second electrode connected to a third node, and a gate electrode connected to the second scan line;

a third light emitting unit connected to the third node, and configured to receive a first voltage and a second voltage and to emit a light; and a third switching transistor comprising a first electrode connected to the first data line, a second electrode connected to the first electrode of the third transistor, and a gate electrode connected to the third scan line, wherein each of the first transistor and the first switching transistor is a first type transistor, and each of the third transistor and the third switching transistor is a second type transistor different from the first type transistor.

10. The display apparatus of claim 9, wherein the third light emitting unit comprises:

a fourth transistor comprising a first electrode configured to receive the first voltage, a second electrode connected to a fourth node, and a gate electrode connected to the third node;

a capacitor connected to and between the third node and the fourth node; and a second light emitting device comprising one end connected to the fourth node and the other end configured to receive the second voltage.

11. The display apparatus of claim 10, wherein the first transistor is a PMOS transistor, the third transistor is an NMOS transistor, the first switching transistor comprises a PMOS transistor, and the third switching transistor comprises an NMOS transistor.

12. The display apparatus of claim 1, wherein the second pixel is further connected to a third scan line, and the second pixel comprises:

a second pixel circuit connected to the first scan line; and a second switching circuit which is configured to provide a second data signal, which is provided from the second data line, to the second pixel circuit in response to a third scan signal provided through the third scan line.

13. The display apparatus of claim 12, wherein the first scan signal and the third scan signal comprise an active period having a first level, and the second scan signal comprises an active period having a second level.

14. The display apparatus of claim 12, wherein the second scan signal and the third scan signal are sequentially activated, and an active period of the second scan signal partially overlaps with an active period of the third scan signal.

15. The display apparatus of claim 1, further comprising:

a gate driving circuit which is configured to drive the first scan line using the first scan signal and the second scan line using the second scan signal;

a data driving circuit which is configured to sequentially output a first data signal and a second data signal to the first channel; and a driving controller configured to control the data driving circuit and the gate driving circuit.

16. The display apparatus of claim 1, wherein the selection signals comprise a first selection signal and a second selection signal, and the selection circuit comprises:

a first switching device configured to electrically connect the first channel to the first data line in response to the first selection signal; and a second switching device configured to electrically connect the first channel to the second data line in response to the second selection signal.

17. A display apparatus comprising:

a selection circuit configured to electrically connect a first channel to one of a first data line and a second data line in response to selection signals;

a first pixel circuit connected to a first scan line;

a first switching circuit connected to and between the first data line and the first pixel circuit configured to provide a first data signal, which is provided from the first data line, to the first pixel circuit in response to a second scan signal from a second scan line; and a second pixel connected to the first scan line and the second data line, wherein a pulse width of a first scan signal configured to be provided to the first scan line and a pulse width of the second scan signal configured to be provided to the second scan line are longer than one horizontal period, wherein the first scan signal and the second scan signal are configured to be sequentially activated, and an active period of the first scan signal partially overlaps with an active period of the second scan signal, wherein a period, in which the second scan signal configured to be transmitted through the second scan line is inactive and the first scan signal configured to be transmitted through t he first scan line is active, is equal to the one horizontal period.

* * * * *